US007065795B2

(12) United States Patent
Hochmuth

(10) Patent No.: US 7,065,795 B2
(45) Date of Patent: Jun. 27, 2006

(54) GOALKEEPER'S GLOVE AND METHOD FOR MAKING SAME

(76) Inventor: Peter Hochmuth, Weissenburger Str. 19, Treuchtlingen (DE) D-91757

( * ) Notice: Subject to any disclaimer, the term of this patent is extended or adjusted under 35 U.S.C. 154(b) by 255 days.

(21) Appl. No.: 10/664,832

(22) Filed: Sep. 17, 2003

(65) Prior Publication Data

US 2004/0088777 A1 May 13, 2004

(30) Foreign Application Priority Data

Sep. 17, 2002 (DE) ..... 102 42 990

(51) Int. Cl.
*A41D 19/00* (2006.01)

(52) U.S. Cl. ..... 2/161.1; 2/169

(58) Field of Classification Search ..... 2/161.1–161.6, 2/163, 169

See application file for complete search history.

(56) References Cited

U.S. PATENT DOCUMENTS

| | | | | |
|---|---|---|---|---|
| 666,853 | A * | 1/1901 | Morgan | 2/169 |
| 3,821,817 | A * | 7/1974 | Jorgensen | 2/169 |
| 5,528,772 | A * | 6/1996 | Cheek | 2/161.1 |
| 6,125,473 | A * | 10/2000 | Hochmuth | 2/161.1 |
| 6,654,964 | B1 * | 12/2003 | Staihar et al. | 2/161.1 |

* cited by examiner

*Primary Examiner*—Katherine M. Moran
(74) *Attorney, Agent, or Firm*—Jensen & Puntigam PS

(57) ABSTRACT

A goalkeepers glove and the method of making the glove for use in a soccer game, wherein the face of the glove or inner portion is fabricated of synthetic rubber and is of a single piece including an extension which is folded and stitched upon itself to encompass the player's thumb. The back of the glove, which may include reinforcement, is likewise of a single piece. The pieces are joined along the edge to form the glove.

29 Claims, 7 Drawing Sheets

GOALKEEPER'S GLOVE AND METHOD FOR MAKING SAME

TECHNICAL FIELD

This invention relates to a goalkeeper's glove, and more particularly, to a goalkeeper's glove wherein the face of the glove is of one piece and includes as a part thereof a piece to surround the thumb when the glove is assembled. The face of the glove is free of seams, since it is attached around the periphery. The glove is made by supplying a front panel, including the thumb, supplying a back panel and securing the two together.

BACKGROUND OF THE INVENTION

In ball centered sports, such as European football, the goalkeeper customarily wears gloves, in order to capture the ball with greater facility or to divert the ball in a selected direction. The said gloves protect the hands from traumatic injury. Such goalkeeper's gloves characterize themselves, for example, by a surface for the inner hand, which is adapted to act as a shock damper, in order to ameliorate the kinetic energy of an approaching ball and, in general, to provide a retention property by the use of a ball-contacting latex layer, all of which improves the operational characteristics of the said gloves.

Such goalkeeper's gloves should, first, exhibit a sufficient adherence to the outside of the hands, second, in doing this, the gloves should not prove to be too stiff, so that the freedom of movement for the fingers and thumb foes not becomes limited at the moment of ball contact.

This favorable situation may be arrived at, in that the glove can be made of a plurality of flat pieces, which consist of a firm substance and which are stitched together. For example, the glove might consist of a inner hand piece and an outer hand piece, which both adhere to the contour of the wearing hand and approximately have a size to fit said hand. The inner hand part and the outer hand part are stitched together, so that the seam runs along the outer peripheries of both said parts. Too many seams, however, are not held desirable in a goalkeeper's glove.

In a goalkeeper's glove, disclosed by DE 298 18 597 U1 and by a corresponding U.S. Pat. No. 6,125,473 A, the part which contacts the inner hand is made in one-piece from latex, and exhibits a palm area, four pre-finger zones and a thumb section which connects onto the said palm area. An inner thumb zone is fully formed from the latex inner hand part. An outer thumb section or upper thumb piece is constructed with a support material of fabric, whereby a portion of the thumb section of the inner hand part is turned back and is finally stitched as an external thumb part onto this support material and the inner thumb construction of the inner hand part is sewn with a peripheral further seam on the support material of the upper thumb section. In the case of this glove, there are in addition, several seams present at the thumbs, which requires an extra amount of production costs and is seen by many goal keepers as obstructive in use.

SUMMARY OF THE INVENTION

Accordingly, it is the purpose of the invention, to make available a goalkeeper's glove and a process for the manufacture of the same, whereby, in comparison with the above mentioned state of the technology, the number of seams on the thumb is diminished.

This purpose is attained in accord with the invention as set forth in claim 1 and as to the process, is achieved in accord with the object of claim 16. Advantageous embodiments are made evident in the subordinate claims.

The goalkeeper's glove, in accord with claim 1 encompasses:

a) an inner hand part, which essentially completely covers over the inside of one hand, b) at least one outer hand part, which at least covers the outside of the hand, c) whereby the inner hand part is of one-piece, or a piece compounded from a single flat piece, and d) whereby the inner hand part possesses a thumb area which is integrated, or attached thereto, and which said thumb area is provided for a full enclosure of the thumb.

Proximal to the wrist there is located on the hand and the glove, that side which is characterized by closing, or bending in, such as when one makes a fist. Therewith is to be understood the contact side of the glove upon the impact, the catching or gripping of a ball. The outside or the back of the hand or glove, is to be understood as that side remote from the said inner side and the stretching side of the fore-finger area. In order to cover the inner side of the hand, the inner hand possesses, generally a forefinger area approaching the fingers, (namely approaching the index, middle, ring and little finger) as well as a palm area.

The outer hand, has, at least, ample coverage for the back of the hand and the forefinger area, and of the corresponding areas on the back of the hand and/or the fingers.

The thumb area of the goalkeeper's glove is now, in accord with the invention, completely constructed from the inner hand area, so that the thumb and the inner hand are protected by the same one-piece palm area. In other words, the palm area covers first the inner surface of the hand completely, and second encompasses the thumb, with a complete encasement. The entire thumb area of the glove is thus completely integrated with the inner hand zone. This agrees with the anatomy of the human hand, since an extending piece of the thumb area is on the inner part of the hand. Thereby, a glove can be made, which agrees optimally with the shape of the hand, so that the mechanical tensions in the glove are minimized. The outer hand part, or the back of the hand part of the glove, does not cover the thumb, that is to say, it possesses no thumb area. This has the advantage, that for this outer hand part, a specially rigid and firm material can be used, without limiting the mobility of the thumb thereby.

The process for the manufacture of a goalkeeper's glove, as found in claim 16, encompasses the following features:

a) making available or fashioning an outer hand part, b) making available or fashioning an inner hand part, which consists of:

- a one-piece flat surface with areas approaching the fingers,
- a palm piece,
- a thumb enclosure attached to the said palm piece, which said enclosure consists of an inner thumb area connected to the palm piece and an outer thumb area joined to the said inner thumb area by a transition piece c) the production of a closed thumb enclosure from the inner hand part by connection, especially by stitching together, of the inner thumb area and the outer thumb area on their peripheral borders encircling the said transition piece.

In this way, on the outer side of the thumb area, only one seam or one place of adhesion or the like occurs. In principal, also for the thumb area of each glove, a shell especially encompasses the inner space provided for a thumb, up to the tip of the said thumb and on the longitudinal sides thereof, thus making a cylinder shape, a cone shell, or another enclosing shape.

In a particularly advantageous embodiment, enclosing the thumb are an inner thumb area and an outer thumb area. These areas are joined together as one-piece by means of a transitional zone. At the location surrounding the tip of the thumb and along the adjacent edge areas following the length of the thumb, the said inner and outer areas are bound together, especially by stitching, with the resulting seam running along the tip areas and following an continuing edge. Because of this construction, the seam, or other joining line, can be made shorter and does not extend itself into the transition zone.

In general, the inner thumb area and the outer thumb area, before the binding or the stitching in the transition zone and especially along a bending line, are bent back or, especially along a particular breaking line are creased or folded and then subsequently flapped to and laid over one another, after which the stitching step can be carried out. Thereby a single folding, creasing or bending of the thumb area suffices, so that the inner hand part falls into the desired contour. By means of the geometric arrangement of one or more fold-lines, the final form of the glove is thus determined and even in the case of a stiffer or thicker material of the thumb covering, this form is not disturbed. Moreover, the folding contributes to the fact, that inexactness in the joining of the outer and the inner thumb areas is largely excluded. Advantageously, the inner thumb area and the outer thumb area are made to be essentially congruent.

Edge areas, along which the inner thumb area and the outer thumb area are combined, are advantageously provided, following a longitudinal inner thumb side proximal to an index finger area of the palm area. In this way, the seam at the thumb area upper side and thus at a non-critical area for ball handling when gripping or engaging in evasive action. The remaining area possesses instead of an unwanted seam, a bending of the thumb area. As a whole, by means of this shaping of the inner hand part, the length of the seam in the thumb area is minimized.

The transition zone is to be found, essentially, between the inner thumb area and the outer thumb area at that longitudinal inner side of the thumb area, which is remote from the index finger area of the inner hand part. In other words, beneath the thumb, so that at that location a continuously smooth surface remains.

The inner hand part and the outer hand part are directly or indirectly joined together along their edges, preferably by stitching. This could also be done, generally by means of one or more interposed side pieces. By means of the provision of side pieces, which are inserted between the inner hand part and the outer hand part, an offset is created between the inner hand part and the outer hand part, and the total shape of the goalkeeper's glove, at that moment fits, which little change, the anatomy of a hand. This leads especially to the situation, that the tensional forces in the glove, which arise from hand movement, remain very small. In particular, provision can be made, that the side parts can be made as a strip insert. By means of the strip insert, the glove receives a kind of sidewall, which distances the inner hand part from the outer hand part.

In an advantageous development, the inner hand part of the glove contiguous to the thumb area, has an extension, which is located on that thumb side which is remote from the inner thumb area thus allowing the extension to connect itself onto the outer thumb area. The extension protectively overlaps part of the palm area and especially protects that side of inner palm which is remote from the central palm area. In other words, the protected area is to be found in the pre-index finger-inner palm area.

A border of the said extension forms, advantageously, a continuation of the outer, longitudinal edge of the index finger, which is remote from the middle finger area, so that at the index finger and the thumb side of the inner hand part, a continuous and at least smooth edge of the border of the inner hand part is formed. In this way, the inner hand part and the outer hand part and/or the side part(s), are stitched together by means of a single, continuous and/or peripherally running smooth seam, which seam extends itself along the edge of the extension and binds this with the outer hand part or side part. Thus, straight or smooth edges of the outer hand part or the side parts are possible, which simplifies their manufacture.

Furthermore, the inner hand part has advantageously a recess between the index finger area and the thumb area. The recess eases the bending back of the thumb area by the turning of the thumb from the inside to the outside and back again. Advantageously, the extension is, or can be, stitched on to the said recess area, especially by means of a single seam to join the thumb area. Upon the act of enclosure of the prepared thumb area, advantageously, the said extension, first, can be stitched at a peripheral border location with the inner hand part below the index finger and preferably stitched at the recess. Favorably, this can be done at the same time that the stitching of the inner thumb area and the outer thumb area takes place. Second the extension can be stitched on a contingent edge zone to the said inner hand part region or the side part, advantageously at the same time as the stitching of the inner hand part with the outer hand part of the side parts.

In a particularly advantageous embodiment, the inner hand part can be made by stamping out, or cutting out a flat piece or a material on an production line. Therewith a simple and economical manner of manufacturing the inner hand part becomes possible.

The material of the inner hand part or the flat piece or the supply belt is advantageously flexible and/or possesses an easily ball gripping surface. Especially advantageous is a latex material, which does possess good capture and passing characteristics for the inner hand part of the goalkeeper's glove. Latex is firm and at the same time resilient and crush resistant. Among the types of latex to be found, besides the natural latex, generally can be procured a polymer on the basis of, preferably, cross-linked, natural rubber, which can be produced as an emulsion and/or as a foam.

In like manner, applicable materials with comparable characteristics are elastomers based on synthetic rubbers, also, in general, linear polymers or chain polymers which, by vulcanization or large mesh networking, are so cross-linked that they obtain a state of soft elastic properties. Examples are siloxane-elastomers (SI), which, as a rule, are made of cross-linked polysiloxanes and polysiloxane compounds, especially a siloxane natural rubber, i.e., SIR, which substance was formerly known as "silicon rubber".

The outer hand (back of hand) part is specially made as a one-piece or compounded flat piece, which is first separated from the inner hand (palm) part. However, the outer hand part and the inner hand parts can be interleaved within one another at the hand edge to seem of one-piece. Additionally, provision can be made, that on the outer hand part a reinforcement is applied, preferably by stitching. In this manner a goalkeeper's glove can be constructed, the outer hand part of which exhibits totally different material than does the inner hand part. For example, a glove with a particularly soft inner hand part, and a very hard outer hand part can be made, which allows protection for the finger joints from being stressfully bend backward. The reinforcement can be a flat piece, which is slightly smaller than the outer hand is. With this construction, the reinforcement is not a disturbing factor, when the outer hand part and the inner hand part join together, especially when this is done by stitching. Advantageously, provision has been made that the reinforcement would have a higher degree of rigidity than does the outer hand part. Therewith the possibility arises, that the outer hand part can be made of a relatively soft material, whereby the stiffness will then be gained by the presence of the reinforcement. Thereby again the possibility arises of making a basic model from a predetermined inner hand part and an outer hand part, wherein the stiffness of the final glove is determined exclusively by the properties of the reinforcement.

BRIEF DESCRIPTION OF THE DRAWINGS

Favored embodiments of the invention are presented in the following, with the reference numbers as shown on the attached drawings, wherewith they are more fully described. The following presentation shows.

BEST MODE FOR CARRYING OUT THE INVENTION

Correspondingly related parts and dimensioning are provided, in the FIGS. 1 to 7, with the same reference numbers.

Figure 1:
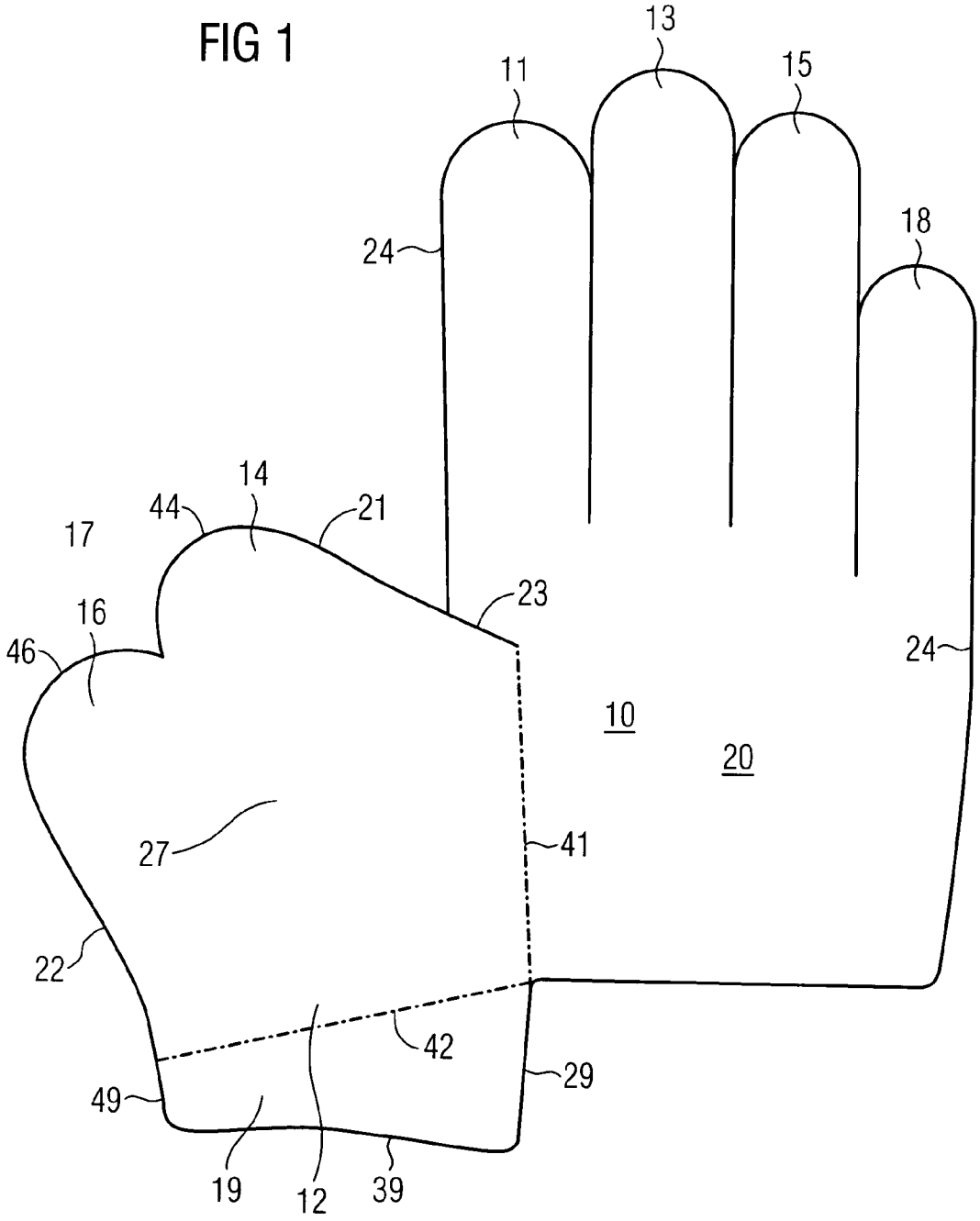
FIG. 1 a plan view of a first embodiment of a sample of an inner hand of a goalkeeper's glove with a thumb area in accord with the invention, FIG. 2 a plan view of a second sample of an inner hand of a goalkeeper's glove with a thumb area in accord with the invention, FIG. 3 a plan view of a third sample of an inner hand of a goalkeeper's glove with a thumb area in accord with the invention, FIG. 4 plan view of the inner hand part, in accord with FIG. 2, after the stitching together of the thumb area, with the said thumb area extending itself outward, FIG. 5 plan view of the inner hand part in accord with FIG. 4, with a thumb area showing itself as extending inward, FIG. 6 a plan view of an embodiment of an outer hand part of a goalkeeper's glove in accord with the invention, and FIG. 7 a profile view of a goalkeepers glove with an inner hand part in accord with FIGS. 5, 6 and an outer hand part in accord with FIG. 4.
Figure 2:
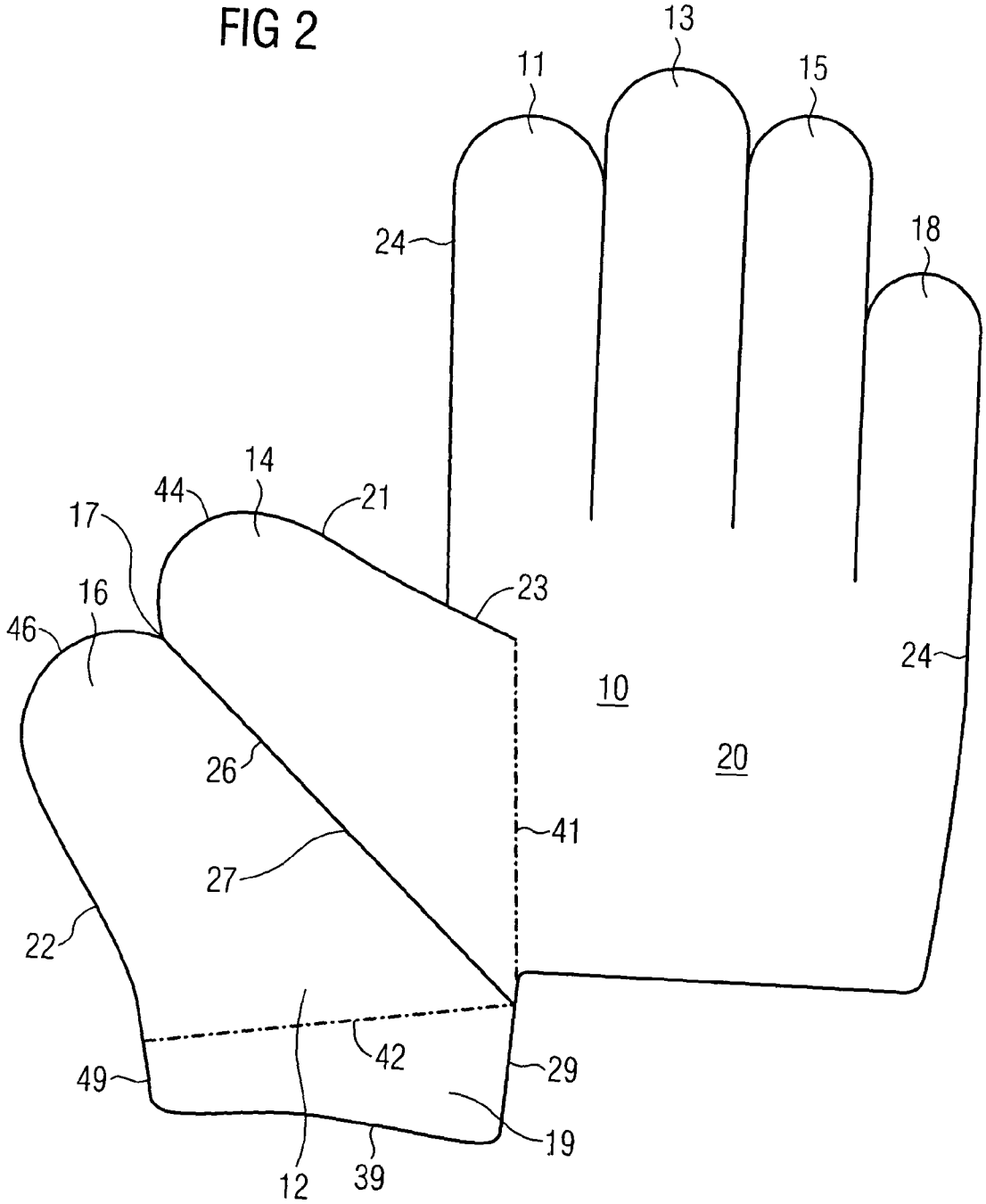
Figure 3:
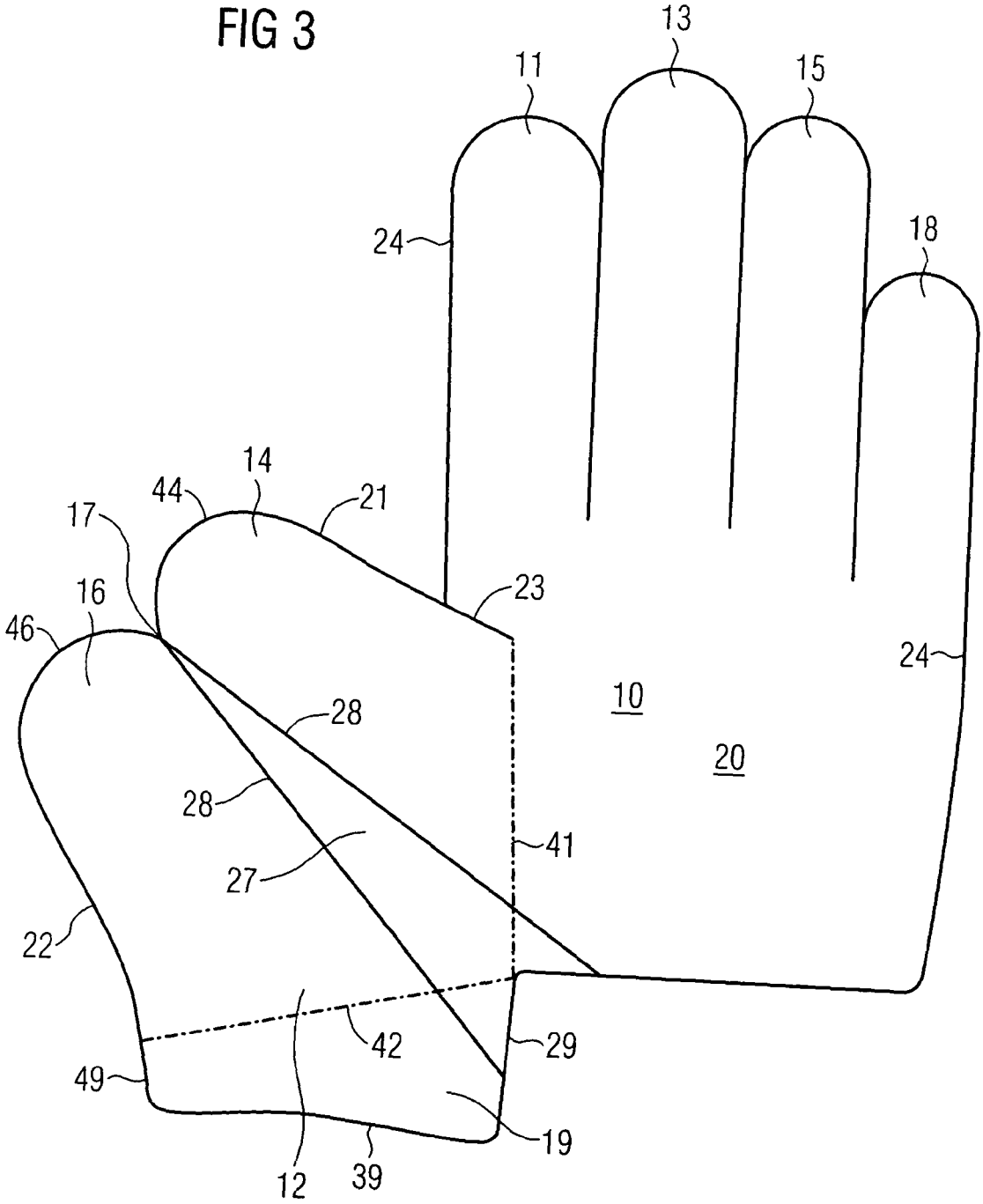

FIGS. 1–3 show various samples of an inner hand part 10 for a goalkeeper's glove. The inner hand part is of one-piece or is compounded and advantageously cut or stamped out of one sheet. The said piece consists preferably of a latex material or a similar, flexible substance with like gripping ability for the seizing of a ball and similar damping features. The inner hand part 10 incorporates four finger areas for the covering of the inner side (or the bending side) of the said four prefinger zones, namely the index finger area, 11, the middle finger area 13, a ring finger area 15 and a little finger area 18, with a thumb area set as a fifth finger. Also included in the inner hand part is a palm area 20, by means of which the said finger areas 11, 12, 13, 15 and 18 are collectively brought together and bound into the glove.

The thumb area 12 is itself encapsulated in a contiguous inner thumb area 14 which is adjacent to the palm area 20 and further attached to a further division of an outer thumb area 16, which is on that glove side which is remote from the palm area 20. An edge zone 21 of the inner thumb area 14, is located proximal to the index finger area 11. An edge zone remote from the inner thumb area 14 of the outer thumb area 16 carries the reference number of 22.

On that side, which is remote from the inner thumb area 14, namely connecting to the outer thumb area 16, the inner hand part 10 possesses an extension 19. There further exists an edge 29 which is situated opposite to the said extension 19, which extension 19 is continued by an edge 49, which also continues the edge 22 of the outer thumb area 16 connecting to a binding edge 39 which connects the two edges 29 and 49.

The extension 19, in FIGS. 1 to 3 assumes a somewhat trapezoidal outline. A separating line between the outer thumb area 16 and the extension 19 is shown as a dotted line. In like manner, a doted line denotes that separation line which divides the inner thumb area 14 from the palm area 20.

The two mentioned separating lines, and the bending line 27 intersect one another at a point on the edge of the inner hand part 10 and the said separating lines serve, as will be later explained, as the so marked bending edges 41 and 42.

At the tips of the thumbs, the two thumb areas 14 (inner) and 16 (outer) have tip areas 44 and 46, which are separated from one another by a recess 17, but connect with one another through the bending area 27 which serves as a transition zone. The two thumb areas 14 and 16 are, in themselves, congruent within the edges 21, 22, tip edges 44, 46, bending edge 27 and the bending edges 41 and 42. Based on the bending line 27, the two thumb areas 14 and 16 are also symmetric to one another and by flapping over, or bending together about the intervening bending line 27, the two thumb area are laid on one another in a mutually covering manner.

In accord with FIG. 2, on the thumb area 12 of the inner hand part 10, additionally another bend, or crease 26 is made in the bending area 27 which is located between the inner thumb area 14 and the outer thumb area 16 which essentially extends itself between the inner thumb area 14 and the outer thumb area 16. Because of this crease 26, the inner hand part 10, as compared to the presentation of FIG. 1, is made of a relatively stiff or thick material, and is accordingly more difficult to bend, For this reason it can be easily flapped over. Beyond this, because of the said creased line 26, the exact bringing together of the inner thumb area 14 and the outer thumb area 16 along the edge 22 is assured.

In the embodiment example shown in FIG. 3, relative to the inner hand part 10, the difference to the embodiments of FIGS. 1 and 2 is made clear by the two straight line creases 28 in the bending zone 27, which are provided between the thumb area 14 and 16. The said two straight line creases 28 form a V-shape or build a V-shaped bending zone, following the bending line of 26. The two creases 28 intersect in the area of the thumb tips or the thumb caps together and run increasingly apart to the edge of the wrist. By the geometric arrangement of the two creases 28, the inner hand part 10 can now be made of a stiffer material and be so formed, that it very easily fits the anatomy of the hand.

During or after the stamping out, or the cutting out of the inner hand part 10, the creases 26, of FIG. 2, and the diverging creases 28 of FIG. 3 can themselves be pressed out. This is a relatively simple procedure, which eases the entire production of the glove.

The now flapped over thumb areas 14, 16, now lying one on the other, which have been fashioned by the bending over at the crease lines 26 or 28 are bound together, at the tips 44 and 46 as well as at the edges 21 and 22, to make a closed thumb area 12, which can be, preferably, stitched. The entire thumb area 12 is thus provided so as to completely enclose the thumbs. For this purpose, the thumb area 12, for example, finds itself bent and secured as a cylinder shell or as a conical shell. This provides a surrounding protection for the complete thumbs.

Figure 4:
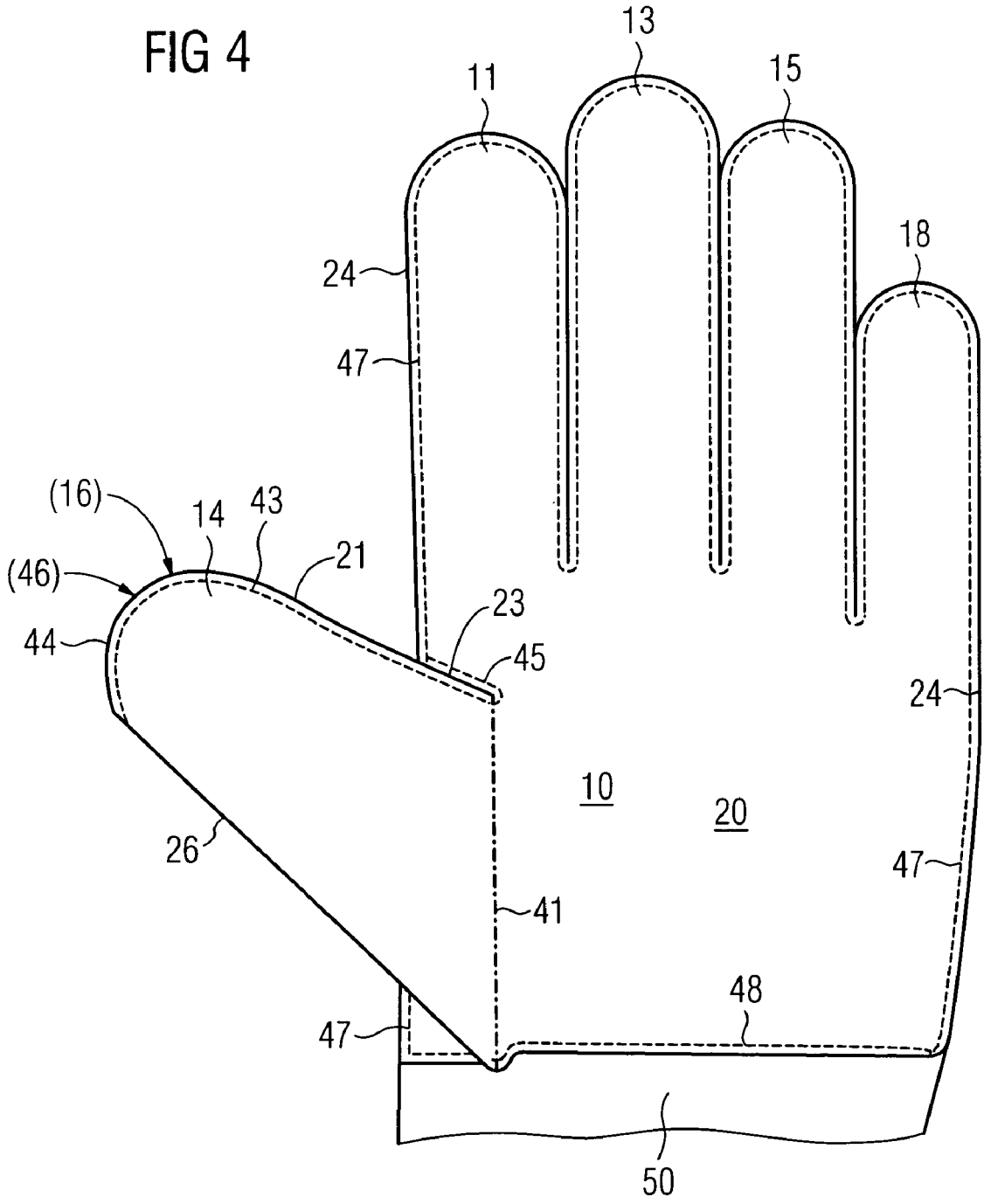
Figure 5:
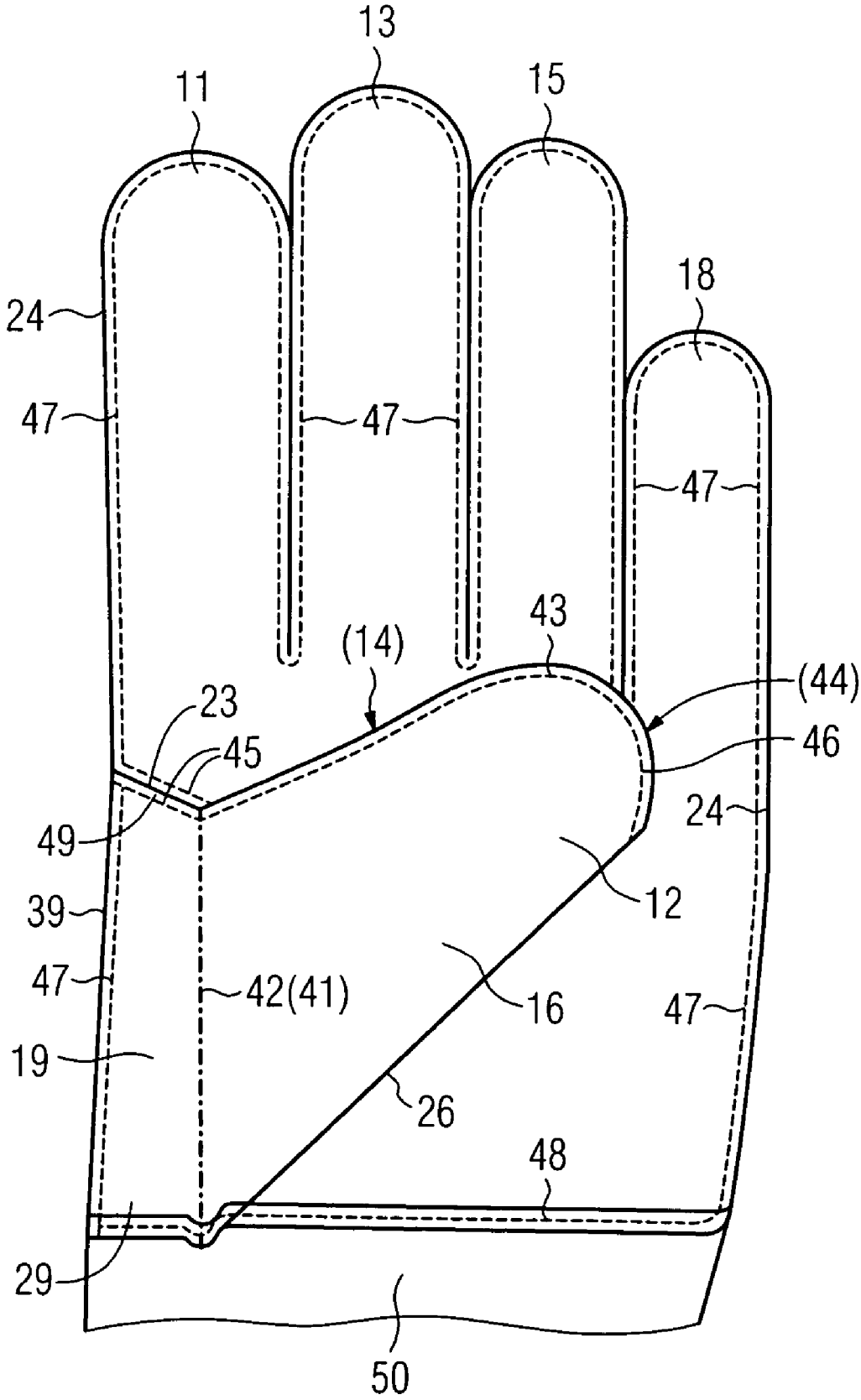

FIGS. 4 and 5 demonstrate the inner hand part 10 with the now closed thumb area 12 in various positions. As to the thumb area, a seam 43 is now present, which runs through the tip areas 44 and 46, and the edges 21 and 22 to the inner thumb area 14 and to the outer thumb area 16, which seam is binding the two overlaying thumb parts together. The individual stitches, or thread sections are shown in FIGS. 4, 5 by a dotted line. At the bending area 27 the two thumb areas 14 and 16, previously discussed, are brought together, and on this account, no seam is necessary. The specific seam 43 of the thumb area 12 extends itself, as said, over the thumb tips 16, 46 and that side of the thumb area 12, which is proximal to the index finger 11. That side of the thumb area 12, which lies further out on the glove, possesses, on the explained account, no disturbing seam.

Figure 6:
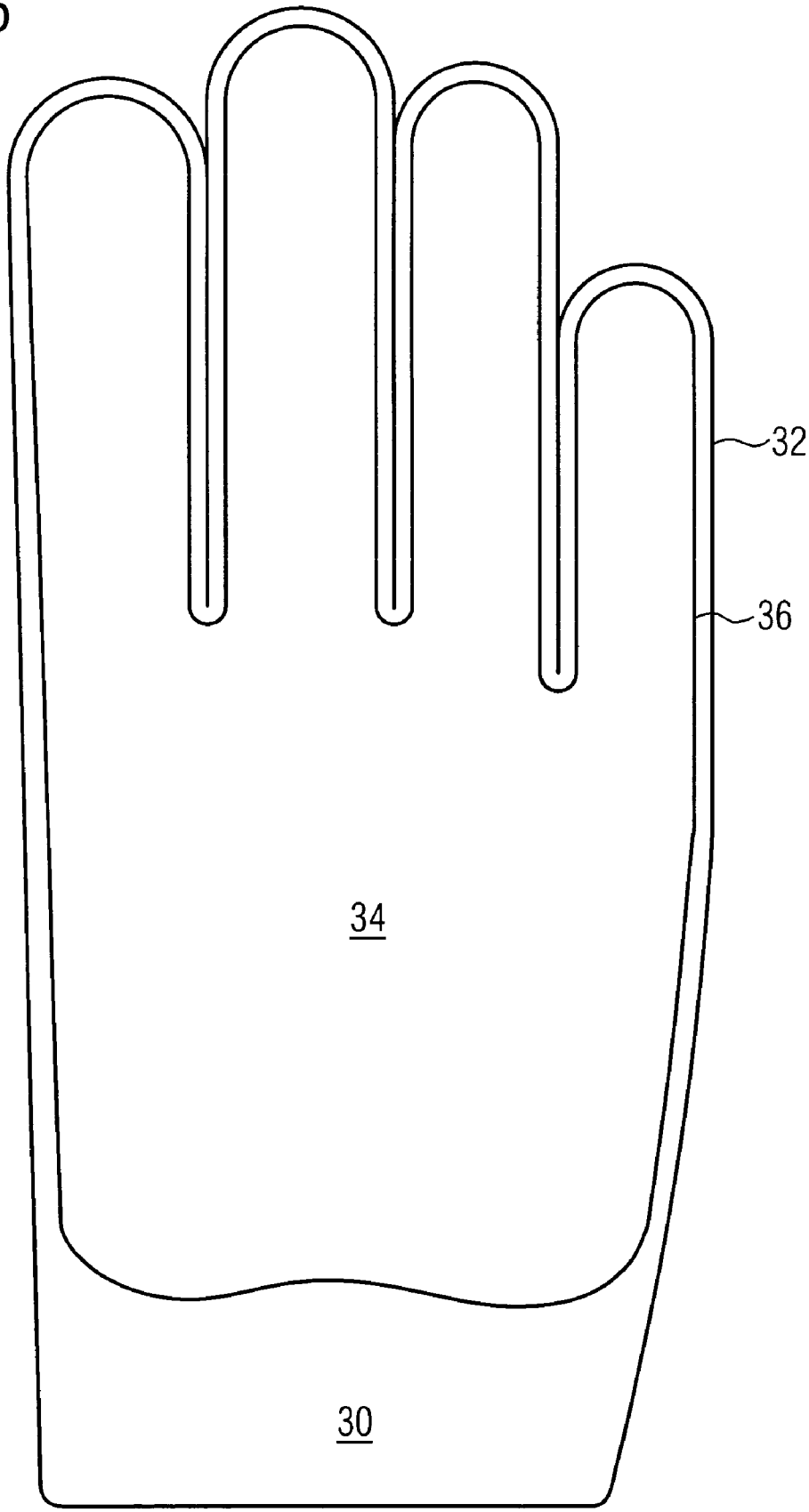
Figure 7:
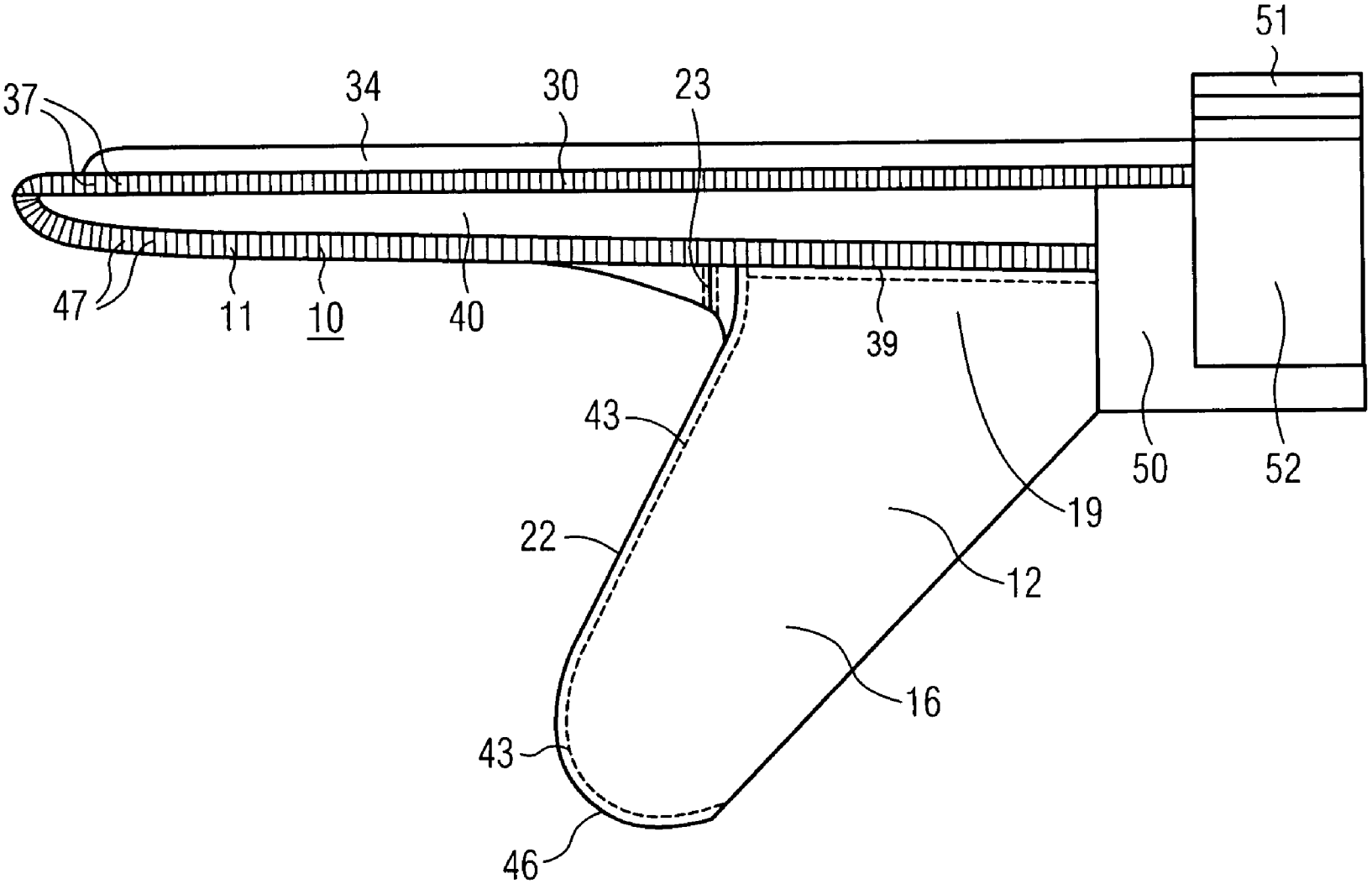

The edge 24 of the remaining inner hand part 10 is provided for the stitching of a (not shown in FIGS. 4, 5) outer hand part, such as, for example, the outer hand part 30, which can be seen in FIGS. 6 and 7.

The inner hand part 10 possesses further in the continuation of the edge 21 of the inner thumb area 14 a recess 23. The recess 23 enables, both in the sample according to FIGS. 1 to 3, as well as in the finished inner hand part as shown in FIGS. 4 and 5, a bending back, or flapping of the entire thumb area 12 about the bending line 41, and in the finished condition, as shown in FIGS. 4 and 5, also folding about crease line 42 which then makes the bend line 41 to lie parallel to (and coincide with) the said line 42. This becomes true, when the thumb area 12, is folded inward to bring the outward projecting thumb tips 44 and 46 (FIGS. 1 and 2) into an inner arrangement (FIG. 4 for instance), wherein bend lines 41 and 42 coincide.

The edge 49 of extension 19, has been folded up to meet the recess 23 as will be seen in FIG. 5. The said edge 49 is stitched to the palm area 20 and/or the index finger 11, thus forming a seam 45. This seam 45, in combination with the seam 43 can form a single seam, or be produced in a single work step. The extension 19 now covers the space behind the thumb area 12, that is to say, the space at that side which is remote from the palm area 20. This said space laterally covers that part of the hand which includes the connecting bones leading to the index finger. The said coverage is complete, so that the entire forward, or inner side of the goalkeeper's glove is formed with the inner hand part 10. The edge 39 of the extension 19 of the inner hand part 10 at the thumb area 12 forms, as this is done, a continuation of the index finger tip 11, which is remote from the extended outer edge of the middle finger area 13, thus allowing a through-running and smooth edge of the inner periphery 24 of the inner hand 10 which is on the thumb side. In this way, the edge 24, including the edge 39 of the inner hand part 10 is made to be essentially smooth. Thereby it becomes possible to allow a binding with the inner hand part 10 of an outer hand part or side part, which is to be stitched on, (see FIG. 7). Further, the stitching with the outer hand part can be done with straight line, or smooth edges. In other words, the seam 47 can be made in one work step. It is, however, also possible to omit the extension 19 on the inner hand part 10 and instead of this, make a corresponding extension on the outer hand part or on the outer side part.

The palm part 20 of the inner thumb area 14 (in the case of an outward extending thumb as per FIG. 4) and the four finger areas 11, 13, 15 and 18 of the inner hand part 10 cover, thus, the complete inner side of a hand. The outer thumb area 16 of the inner hand part 10 is provided for the covering of the upper side or the outer side of the thumb (FIG. 5). At the wrist side of the inner hand part 10, a wrist section 50 of the goalkeeper's glove attaches itself, which can be designed in a known manner and is stitched with the inner hand part 10 at the lower edge thereof forming a seam 48.

FIG. 6 provides an embodiment example of an outer hand part 30, that shows, first, the back of the hand and, second, the outer sides of the four fingers are covered. The outer hand part 30 possesses no thumb area, since the thumbs are already completely covered by the inner hand part 10. Along the edge 32 of the outer hand part 30, the said outer part 30 and the inner hand part 10 are joined, preferably stitched together, and this is done either directly or indirectly by means of side pieces. Furthermore, the outer hand part 30 possesses a reinforcement 34, which, advantageously, is designed as a flat piece. The reinforcement 34 has, essentially, the same contour as the outer hand part 30, but is made somewhat smaller, so that outward on the outer hand part 30 a border area without the reinforcement 34 exists between the edge 36 of the reinforcement and the edge 32 of the outer hand part 30. This said border area is reserved for the stitching on of the inner hand part 10 or the side parts. The reinforcement 34 is attached to the inner hand part 30, especially by stitching along its edge 36 on the outer hand part 30. Instead of stitching, it is possible to substitute an adhesive binding, a welding, vulcanization or the like. The reinforcement 34 can, for instance, be made of a stiffer material than the remainder of the outer hand part 30. The reinforcement 34 can also exhibit reinforcements which are only effective in one direction. For instance, longitudinally extending stiffening elements can be provided, which run parallel to the fingers. These stiffening elements can, for example, only be flexible in one direction, so that they can oppose a tendency toward bending the fingers back in the direction of the back of the hand. Thereby traumatic damage is avoided and the capability of capturing the ball is increased.

In accord with the invention, finally, FIG. 7 demonstrates a finished goalkeeper's glove as presented in a profile view. To be seen in the drawing, is the folded-up thumb area 12, extending downward, and the flat design of the inner hand part 10 along the index finger edges at the finger area 11 and in the extension at the edge 39. The inner hand part 10, is stitched, showing the seam 47 with its side part 40. These are made out of strips of flexible material, especially a textile and/or a synthetic substance. The side part 40 is stitched on the opposite side with the outer hand part 30 to show a seam 37. Further, the wrist part 50 is shown in somewhat more detail with a Velcro-type closure 52 for a surrounding band 51 for the adjustment of the diameter and to make an appropriate fitting of the wrist piece 50.

In an embodiment which is not presented here, it is possible that on that side of the inner hand part 10, which is proximal to the hand, at least partially, an inner lining or a textile inlay can be provided, in order to avoid direct contact of the skin with latex.

In a further, again not presented embodiment, the inner hand part 10 can even be extended to the edge of the hand area on that edge lying under the little finger area 18 of the palm area 20 and drawn around the edge of the hand and be brought into contact with the back of the hand part 30 or even made of one-piece with this said hand part 30.

| Reference Number and Corresponding Components | |
|---|---|
| 10 | Inner palm or inner hand |
| 11 | Index finger area |
| 12 | Thumb area |
| 13 | Middle finger area |
| 14 | Inner thumb area |
| 15 | Ring finger area |
| 16 | Outer thumb area |
| 17 | Recess |
| 18 | Little finger area |
| 19 | Extension |
| 20 | Palm area |
| 21 | Edge of inner thumb area |
| 22 | Edge of outer thumb area |
| 23 | Recess |
| 24 | Edge of inner hand |
| 26 | Bending edge |
| 27 | Bend edge |
| 28 | Bending edge |
| 29 | Edge zone of extension |
| 30 | Outer hand part (back of hand) |
| 32 | Edge of the outer hand part |
| 34 | Reinforcement |
| 36 | Edge of the reinforcement |
| 37 | Seam |
| 39 | Edge of the extension |
| 40 | Side piece |
| 41 | Bending area |
| 42 | Bending area |
| 43 | Seam |
| 44 | Tip of the inner thumb area |
| 45 | Seam |
| 46 | Tip of the outer thumb area |
| 47 | Seam |
| 48 | Seam |
| 49 | Edge of the extension |
| 50 | Hand grip part |
| 51 | Band |
| 52 | Closure |

What is claimed is:

1. A glove for goalkeepers which includes:

a) an inner hand part, which substantially covers at least the inner side of a hand;

b) at least one outer hand part which at least substantially covers the outside of the hand;

c) wherein the inner hand part is of one-piece;

d) wherein the inner hand part has a thumb area which encloses the thumb;

e) in which the thumb area possesses an inner thumb area and an outer thumb area, which are connected as a single piece by means of a transition area, and a tip region associated with the tip of the thumb, as well as at least one adjacent edge region associated with a longitudinal side of the thumb, the said thumb areas are bound together with one another; and f) wherein the edge regions on which the inner thumb area and the outer thumb area are bound together, are placed on a longitudinal inner side of the thumb area, which is proximal to the index finger part of the inner hand part of the thumb area.

2. A glove for goalkeepers in accordance with claim 1, wherein said transition area between the inner thumb and the outer thumb area is placed at a longitudinal outer side of the thumb area, which is remote from an index finger area of the inner hand part.

3. A glove for goalkeepers in accordance with claim 1, wherein the inner thumb area and the outer thumb area are essentially congruent.

4. A glove for goalkeepers in accordance with claim 1, wherein the thumb area, especially in the transition area, between the inner thumb area and the outer thumb area, possesses at least one predetermined, folding edge.

5. A glove for goalkeepers in accordance with claim 1, wherein the inner hand part consists of a latex material.

6. A glove for goalkeepers in accordance with claim 1, wherein the inner hand part consists of a material based on synthetic rubber.

7. A glove for goalkeepers in accordance with claim 1, wherein the inner hand part and the outer hand part are bound together along their edges.

8. A glove for goalkeepers in accordance with claim 1, wherein the inner hand part and the outer hand part are bound or stitched together along their edges by means of at least one separate side piece or strip therebetween.

9. A glove for goalkeepers in accordance with claim 1, wherein the outer hand part is designed as a single piece.

10. A glove for goalkeepers in accordance with claim 1, wherein the outer hand part includes a reinforcement which is overlaid and which is especially designed as a flat piece and which is slightly smaller than the outer hand part and exhibits a greater rigidity than does the outer hand part.

11. A glove for goalkeepers in accordance with claim 1, wherein the inner hand part between the index finger area and the thumb area exhibits a recess.

12. A glove for goalkeepers in accordance with claim 1, wherein said thumb areas are connected with one another by stitching.

13. A glove for goalkeepers which includes:

a) an inner hand part, which substantially covers at least the inner side of a hand, including the index and middle fingers;

b) at least one outer hand part which at least substantially covers the outside of the hand, including the index and middle fingers;

c) wherein the inner hand part is of one-piece;

d) wherein the inner hand part has a thumb area which encloses the thumb;

e) wherein the inner hand part possesses an extension which projects from the thumb area, and which said extension covers an area behind the thumb area; and f) wherein the inner hand part and the outer hand part are stitched together by means of a single continuous and peripherally-running seam, which said seam is preferably essentially in one plane, which seam extends itself also over the said edge of the extension and connects the extension with the outer hand part of the side piece respectively.

14. A glove for goalkeepers in accordance with claim 13, wherein an edge of the extension of the inner hand part forms a prolongation of the outer edge of the index finger area which is remote from the middle finger area, so that at the index finger side and the thumb side of the inner hand part, a continuous and even edge of the border of the inner hand part is formed.

15. A glove for goalkeepers in accordance with claim 13, wherein the inner hand part between the index finger area and the thumb area exhibits a recess and on the edge area of the recess an edge region of the extension is stitched.

16. A glove for goalkeepers in accordance with claim 13, wherein the inner hand part between the index finger area and the thumb area exhibits a recess and on the edge areas of the recess an edge region of the extension is stitched, forming a single seam with the thumb area.

17. A glove for goalkeepers in accordance with claim 13, wherein said extension being connected to the thumb area side remote from the inner thumb area but contiguous with the outer thumb area.

18. A glove for goalkeepers in accordance with claim 13, wherein said extension covers an area on the side remote from the palm area in the direction toward the back-of-hand-bone belonging to the index finger.

19. A process for the manufacture of a goalkeeper's glove, wherein said process has the following steps:

a) the making available or the manufacture of an outer hand part;

b) the making available or the manufacture of an inner hand part, which is designed as a flat, one-piece item having pre-finger areas, a palm area and a thumb area contingent with the said palm area, which said thumb area includes an inner thumb area and an outer thumb area connected to the said inner them area by a transition area;

c) the making of a closed thumb area from the inner hand part by uniting of the inner thumb area and outer thumb area on their edges which lie outside of the transition area;

d) wherein the inner thumb area and the outer thumb area, prior to the binding or connecting or the stitching, are bent over in the transition area or bent, and are overlapped or laid one upon the other; and e) wherein the inner hand part is additionally provided with an extension, wherein the extension, upon the production of the closed thumb area, on one hand side is stitched at an edge with the inner hand part underneath the index finger area, and on the other hand side, the said extension is stitched at a contiguous edge with the outer hand part or the side part.

20. A process in accordance with claim 19, wherein the inner hand part and the outer hand part are connected together along the edges.

21. A process in accordance with claim 19, wherein the inner hand part and the outer hand part are connected together along the edges by means of at least one side piece.

22. A process in accordance with claim 19, wherein the inner thumb area and the outer thumb area are stitched together by a single, continuous seam along the tip area and along a contiguous edge.

23. A process in accordance with claim 19, wherein the inner hand part is made by cutting out of flat work piece.

24. A process in accordance with claim 19, wherein the inner hand part is composed of flexible material which has a grippable surface of latex and/or synthetic rubber.

25. A process in accordance with claim 19, wherein said uniting of the inner thumb area and the outer thumb area is made by stitching together.

26. A process in accordance with claim 19, wherein said bending of the inner thumb area and the outer thumb area is made along one of impressed folding edges lines.

27. A process in accordance with claim 19, wherein said extension is attached to the outer thumb area and/or stitched at a recess.

28. A process in accordance with claim 19, wherein said stitching of the extension being with the same seam or the same stitching step as in the case of the stitching of the inner thumb area and the outer thumb area.

29. A process in accordance with claim 19, wherein said extension is so stitched as to form the same seam with which the outer hand part or the side part or parts are stitched in the remaining areas.

* * * * *